US006689020B2

(12) United States Patent
Stearns et al.

(10) Patent No.: US 6,689,020 B2
(45) Date of Patent: Feb. 10, 2004

(54) EXERCISE APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068

( * ) Notice: Subject to any disclaimer, the term of this patent is extended or adjusted under 35 U.S.C. 154(b) by 0 days.

(21) Appl. No.: 09/835,432

(22) Filed: Apr. 16, 2001

(65) Prior Publication Data

US 2002/0055420 A1 May 9, 2002

Related U.S. Application Data

(63) Continuation-in-part of application No. 09/706,581, filed on Nov. 3, 2000.
(60) Provisional application No. 60/163,578, filed on Nov. 5, 1999.

(51) Int. Cl.[7] ..... A63B 69/16; A63B 22/00
(52) U.S. Cl. ..... 482/52; 482/70
(58) Field of Search ..... 482/51, 52, 53, 482/57, 70, 79, 80

(56) References Cited

U.S. PATENT DOCUMENTS

| | | | | | |
|---|---|---|---|---|---|
| 4,786,050 | A | | 11/1988 | Geschwender | 272/73 |
| 5,279,529 | A | | 1/1994 | Eschenbach | 48/57 |
| 5,383,829 | A | | 1/1995 | Miller | 482/57 |
| 5,518,473 | A | | 5/1996 | Miller | 482/51 |
| 5,529,555 | A | * | 6/1996 | Rodgers, Jr. | 482/57 |
| 5,848,954 | A | | 12/1998 | Stearns et al. | 482/52 |
| 5,882,281 | A | | 3/1999 | Stearns et al. | 482/51 |
| 5,916,065 | A | * | 6/1999 | McBride et al. | 482/57 |
| 6,024,676 | A | | 2/2000 | Eschenbach | 482/51 |
| 6,080,086 | A | | 6/2000 | Maresh et al. | 482/57 |
| 6,277,056 | B1 | * | 8/2001 | McBride et al. | 482/57 |

* cited by examiner

*Primary Examiner*—Stephen R. Crow

(57) ABSTRACT

An exercise apparatus includes a frame; left and right first cranks rotatably mounted on the frame; left and right second cranks rotatably mounted on the frame; left and right foot supports movably supported on respective first cranks and respective second cranks; left and right rocker links pivotally mounted on the frame and operatively connected to respective foot supports; and left and right drawbar links movably interconnected between respective rocker links and respective cranks. The resulting assembly constrains the foot supports to move up and down together with respective cranks, and constrains the foot supports to move back and forth through a relatively greater range of motion.

24 Claims, 9 Drawing Sheets

155
155
190
100
110
180
181
119
114
151
150
202
120
185
131
122
121
116
175
130
201
112
160
221
222
223
220
170

600
610
651
675
687
650
612
720
731
721
723
730
631
620
621
623
641
630
690
640

EXERCISE APPARATUS WITH ELLIPTICAL FOOT MOTION

CROSS-REFERENCE TO RELATED APPLICATIONS

This application is a continuation-in-part of U.S. patent application Ser. No. 09/706,581, filed on Nov. 3, 2000, and also discloses subject matter entitled to the filing date of U.S. Provisional No. 60/163,578, filed on Nov. 5, 1999.

FIELD OF THE INVENTION

The present invention relates to exercise methods and apparatus and more particularly, to exercise equipment that facilitates movement of a person's feet through generally elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. For example, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; U.S. Pat. No. 5,882,281 to Stearns et al.; and U.S. Pat. No. 6,080,086 to Maresh et al.

SUMMARY OF THE INVENTION

Generally speaking, the present invention provides a novel linkage assembly and corresponding exercise apparatus suitable for linking circular motion to relatively more complex, generally elliptical motion. The present invention may be described in terms of, among other things, an exercise apparatus having two pairs of cranks rotatably mounted on a frame. A left foot supporting assembly is supported by the left cranks, and a right foot supporting assembly is supported by the right cranks. Left and right rocker links are pivotally mounted on the frame and operatively connected to respective foot supporting assemblies. Left and right drawbar links have respective first ends that are operatively connected to respective rocker links, and respective second ends that are constrained to rotate together with the respective cranks. The resulting arrangement links horizontal displacement of the cranks to relatively greater horizontal displacement of a person's feet.

On one embodiment, the foot supporting assemblies include left and right rails that are rotatably interconnected between respective cranks, and left and right foot skates that are movably mounted on respective rails. The rocker links are operatively connected to respective foot skates and to respective drawbar links. As a result, the rails are constrained to move through respective circular paths relative to the frame, while the foot skates are constrained to move back and forth relative to respective rails.

On another embodiment, the foot supporting assemblies include left and right rollers rotatably mounted on respective cranks, and left and right foot supports supported on respective rollers. The rocker links are operatively connected to respective foot supports and to respective drawbar links. As a result, the foot supports are constrained to move up and down together with respective cranks, and back and forth relative to respective cranks.

On yet another embodiment, which combines features of the previous two embodiments, the foot supporting assemblies include left and right rails that are rotatably connected to respective first cranks, and left and right foot supports that are supported by rollers on respective second cranks. The foot supports are connected in telescoping fashion to respective rails. The rocker links are operatively connected to respective foot supports and to respective drawbar links. As a result, the foot supports are constrained to move up and down together with respective rails, and back and forth relative to respective rails.

Among other things, the present invention may be considered advantageous to the extent that the available stride length is relatively large as compared to overall machine size; the stride length is adjustable through a relatively large range of motion; and/or the foot supports remain in a single, desirable orientation during exercise activity. Various features and/or advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

The present invention provides elliptical motion exercise machines and methods that link rotation of left and right cranks to generally elliptical motion of left and right foot supports. The term "elliptical motion" is intended in a broad sense to describe a closed path of motion having a relatively longer, major axis and a relatively shorter, minor axis (which extends perpendicular to the major axis). In general, the present invention may be said to use displacement of the cranks to move the foot supports in a direction coincidental with the minor axis, and displacement of crank driven members to move the foot supports in a direction coincidental with the major axis. As a result, the crank diameter determines the length of the minor axis, but only indirectly affects the length of the major axis.

The embodiments disclosed herein are generally symmetrical about a vertical plane extending lengthwise through a floor-engaging base. Linkage assembly components on the left side of the machines are preferably one hundred and eighty degrees out of phase relative to their opposite side counterparts. Also, to the extent that reference is made to forward or rearward portions of a machine, it is to be understood that a person can typically exercise while facing in either direction relative to the disclosed linkage assembly.

Figure 1:
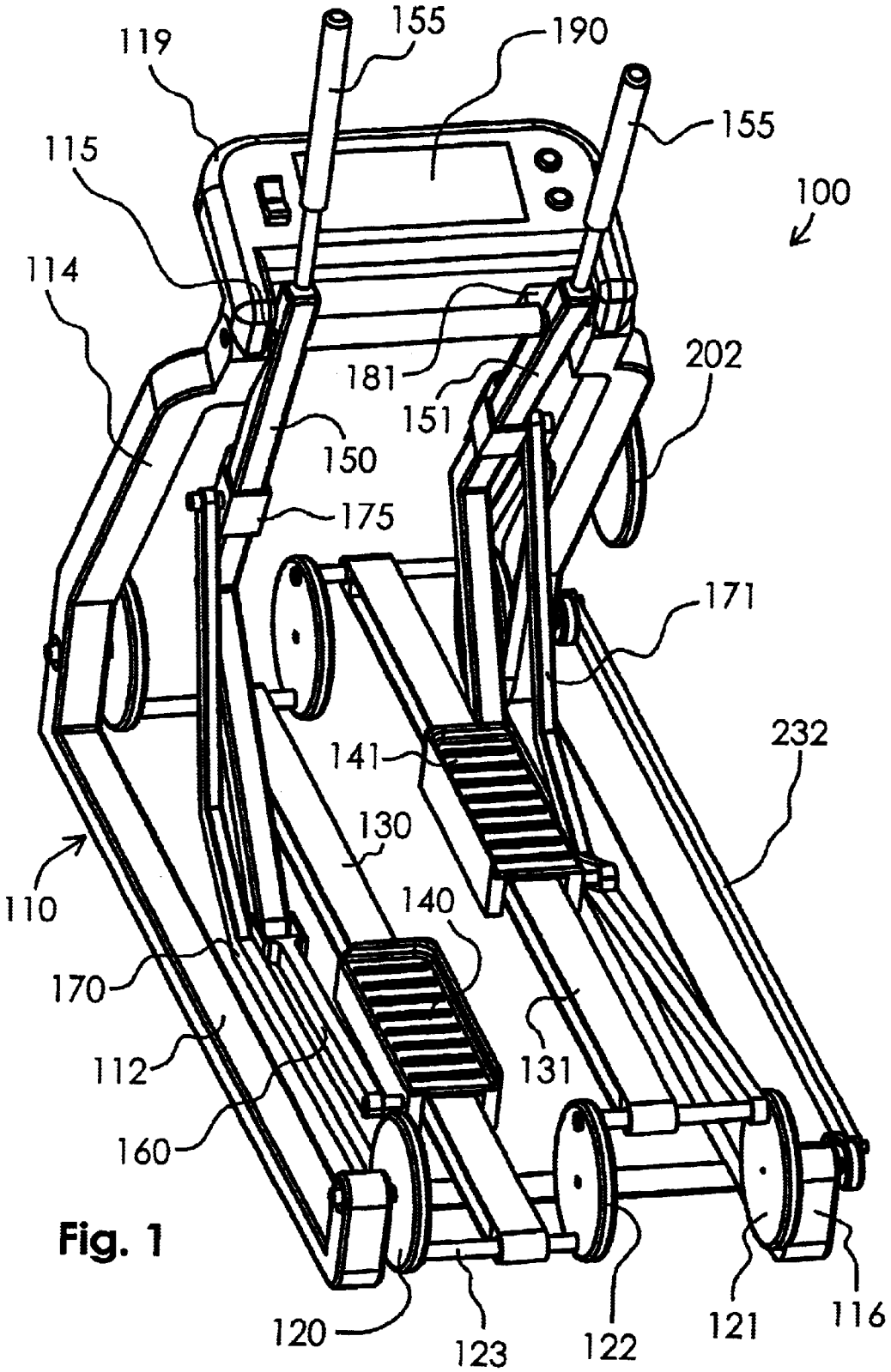
FIG. 1 is a perspective view of an exercise apparatus constructed according to the principles of the present invention.
Figure 2:
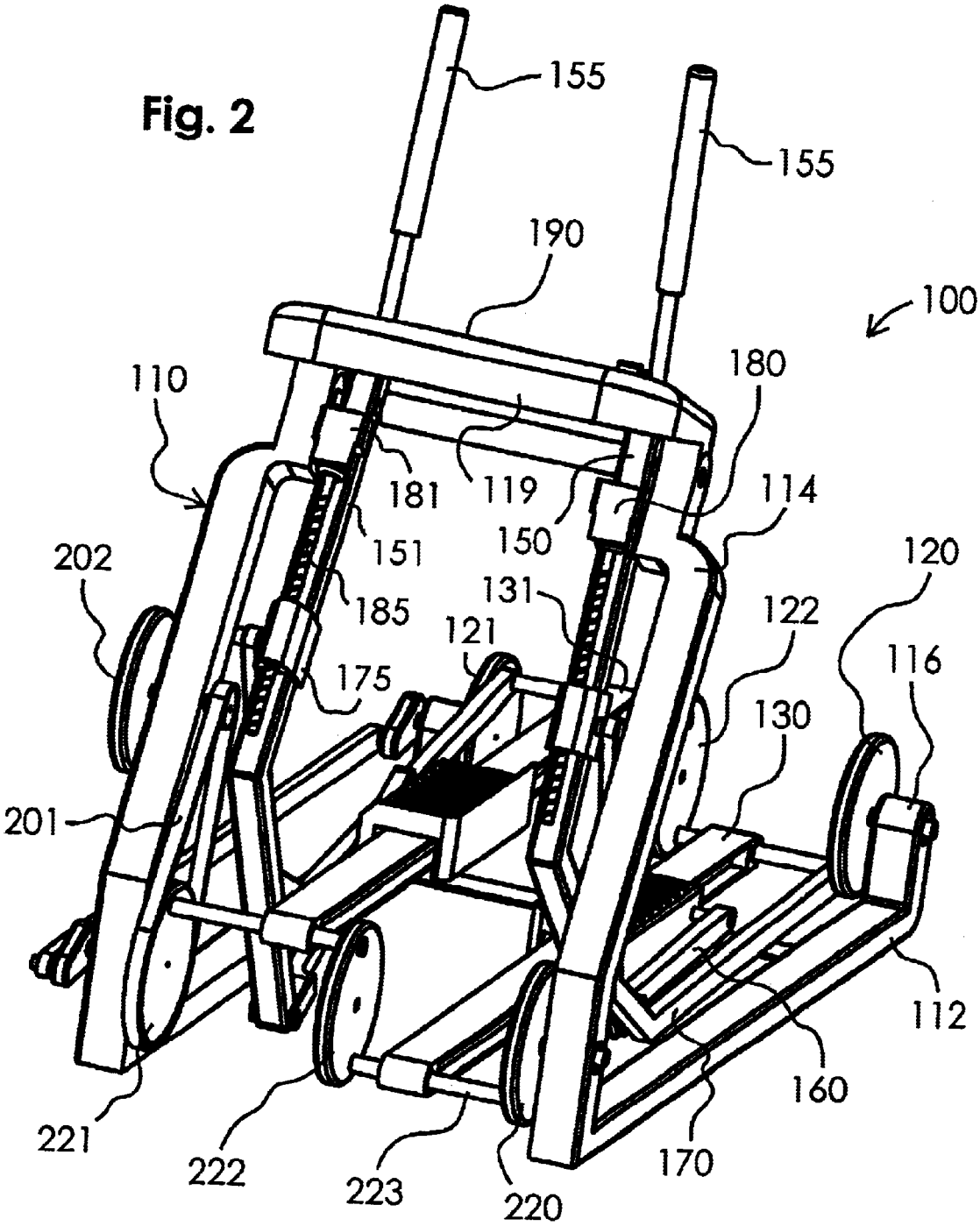
FIG. 2 is another perspective view of the exercise apparatus of FIG. 1.
Figure 3:
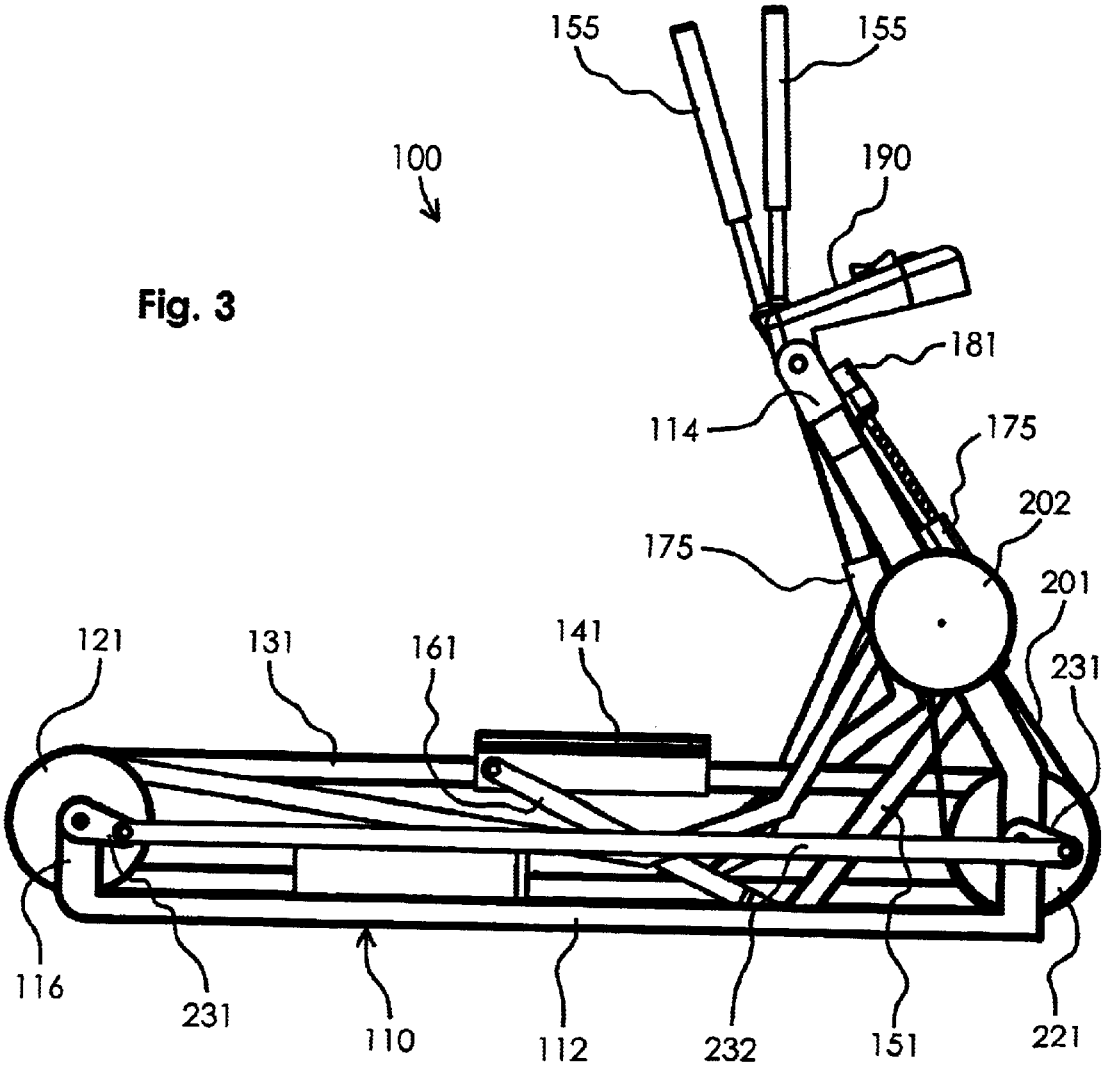
FIG. 3 is a side view of the exercise apparatus of FIG. 1.

One embodiment of the present invention is shown in FIGS. 1–3 and assigned reference numeral 100. The machine 100 generally includes a frame 110; left and right linkage assemblies movably mounted on the frame 110; and a user interface 190 mounted on the frame 110. The interface 190 may be designed to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

The frame 110 includes a floor engaging base 112; a forward stanchion 114 that extends upward from opposite sides of the base 112, proximate the front end of the frame 110; and rearward supports 116 that extend upward from respective sides of the base 112, proximate the rear end of the frame 110. The forward stanchion 114 may be described as an inverted U-shaped member having a middle portion or console portion 119 that supports the user interface 190, and generally vertical leg portions that define a gap therebetween. The console portion 119 may be configured to support additional items, including a water bottle, for example.

Each linkage assembly includes a rearward crank 120 or 121 rotatably mounted to a respective support 116 and rotatable about a common crank axis. Left and right support shafts 123 are rigidly secured to radially displaced portions of respective cranks 120 and 121, and define respective, diametrically opposed axes. A central crank disc 122 is rigidly interconnected between the inward ends of the diametrically opposed shafts 123, thereby constraining the left and right linkage assemblies to remain one hundred and eighty degrees out of phase with one another.

Each linkage assembly also includes a forward crank 220 and 221 rotatably mounted to a respective side of the stanchion 114 and rotatable about a common crank axis. Left and right support shafts 223 are rigidly secured to radially displaced portions of respective cranks 220 and 221, and define respective, diametrically opposed axes. A central crank disc 222 is rigidly interconnected between the inward ends of the diametrically opposed support shafts 223, thereby constraining the left and right linkage assemblies to remain one hundred and eighty degrees out of phase with one another.

Each linkage assembly also includes a rail 130 or 131 having a rearward end that is rotatably mounted on a respective rearward support shaft 123, and an opposite, forward end that is rotatably mounted on a respective forward support shaft 223. As a result of this arrangement, the rails 130 and 131 are constrained to move through respective circular paths in response to rotation of the cranks 120 and 121 and 220 and 221.

Each linkage assembly also includes a foot support or skate 140 or 141 movably mounted on a respective rail 130 or 131. Rollers or bearings are preferably disposed between the foot supports 140 and 141 and respective rails 130 and 131 to facilitate a smooth gliding interface therebetween. In any event, the foot supports 140 and 141 are constrained to move vertically together with respective rails 130 and 131, but remain free to move horizontally relative to respective rails 130 and 131. In this regard, the "skate" arrangement effectively "de-couples" the foot supports 140 and 141 from the horizontal displacement of the cranks 120 and 121 and 220 and 221.

Each linkage assembly also includes a rocker link 150 or 151 pivotally mounted on a respective side of the stanchion 114 and pivotal about a common pivot axis. On the embodiment 100, each rocker link 150 and 151 is pivotally connected to a common support shaft 115 that spans the stanchion 114. Each rocker link 150 and 151 has an upper distal portion 155 that is sized and configured for grasping. Each rocker link 150 and 151 has an opposite, generally L-shaped lower portion that extends downward and then rearward. Forward ends of respective intermediate links 160 are rotatably connected to lower distal ends of respective rocker links 150 and 151, and opposite, rearward ends of respective intermediate links 160 are rotatably connected to respective foot supports 140 and 141.

Each linkage assembly also includes a drawbar link 170 or 171 having a rearward end pivotally coupled to a respective crank 120 or 121, and a forward end pivotally coupled to a respective rocker link 150 or 151. In the alternative, the rearward end of each drawbar link 170 and 171 may be pivotally coupled to a respective rail 130 or 131 (outside the path of a respective foot support 140 or 141). In any event, each drawbar link 170 or 171 links rotation of a respective crank 120 or 121 to reciprocal pivoting of a respective rocker link 150 or 151. The "pivot arm" or radius associated with the drawbar links 170 and 171 is shorter than the "pivot arm" or radius associated with the intermediate links 160 and 161, so the foot supports 140 and 141 are constrained to move fore and aft to a greater extent than the drawbar links 170 and 171. This "amplification effect" may be adjusted by securing the drawbar links 170 and 171 in alternative locations along respective rocker links 150 and 151.

On the machine 100, each drawbar link 170 or 171 is pivotally connected to a respective bracket 175, which in turn, is movably mounted on a respective rocker link 150 or 151. Low friction material is preferably disposed between the brackets 175 and respective rocker links 150 and 151 to facilitate a smooth gliding interface therebetween. Actuators or stepper motors 180 and 181 are mounted on respective rocker links 150 and 151, and are connected to respective brackets 175 via respective lead screws 185. The actuators 180 and 181 may be connected to the interface 190 (or another suitable controller) via a receiver and transmitter combination, or by respective wires routed through respective rocker links 150 and 151 and then through the support shaft 115. The lead screws 185 are threaded through respective brackets 175, and the actuators 180 and 181 are operable to rotate respective lead screws 185 and thereby move respective brackets 175 along respective rocker links 150 and 151. As the brackets 175 are moved closer to the pivot axis of the rocker links 150 and 151, the amplification effect is increased, and the foot supports 140 and 141 are constrained to move through relatively longer paths.

The machine 100 is shown with a bar 232 rotatably interconnected between forward and rearward crank arms 231, which are keyed to respective cranks 121 and 221. The bar 232 is ninety degrees out of phase with the rails 130 and 131, and it cooperates with the rails 130 and 131 to maintain reliable synchronization between the rearward cranks 120 and 121 and the forward cranks 220 and 221.

The machine 100 is also shown with a flywheel 202 rotatably mounted on the right side of the stanchion 114. As shown in FIG. 2, a belt 201 is looped about the crank 221 and about a relatively smaller diameter pulley, which in turn, is keyed to the flywheel 202. As a result, the flywheel 202 is constrained to rotate at a relatively faster speed than the crank 221. The flywheel 202 adds inertia to the linkage assemblies, and various types of known devices (such as a drag strap or an eddy current brake) may be operatively connected to the flywheel 202 to provide adjustable resistance, as well.

An advantage of the machine 100 is that essentially the entire length of the machine 100 is available for accommodating movement of a person's feet through desirable elliptical paths. As a result, both the footprint or planform of the machine 100 and the space needed for its operation are relatively small in comparison to the available stride length. Another advantage of the machine 100 is that the stride length may be adjusted during exercise activity. Also, the foot platforms 140 and 141 remain in a single, desirable orientation during exercise activity.

Still another desirable feature of the machine 100 is that the foot platforms 140 and 141 are positioned in close proximity to one another, thereby accommodating foot motion which may be considered a better approximation of real life striding motion. In this regard, the opposite side cranks 120 and 121 and 220 and 221 and the central support cranks 122 and 222 eliminate the need for a frame supported bearing assembly between the foot platforms 140 and 141. In the absence of a central bearing assembly, one or more shields or guards may be disposed between the opposite side foot supports 140 and 141 in order to eliminate pinch points.

Figure 4:
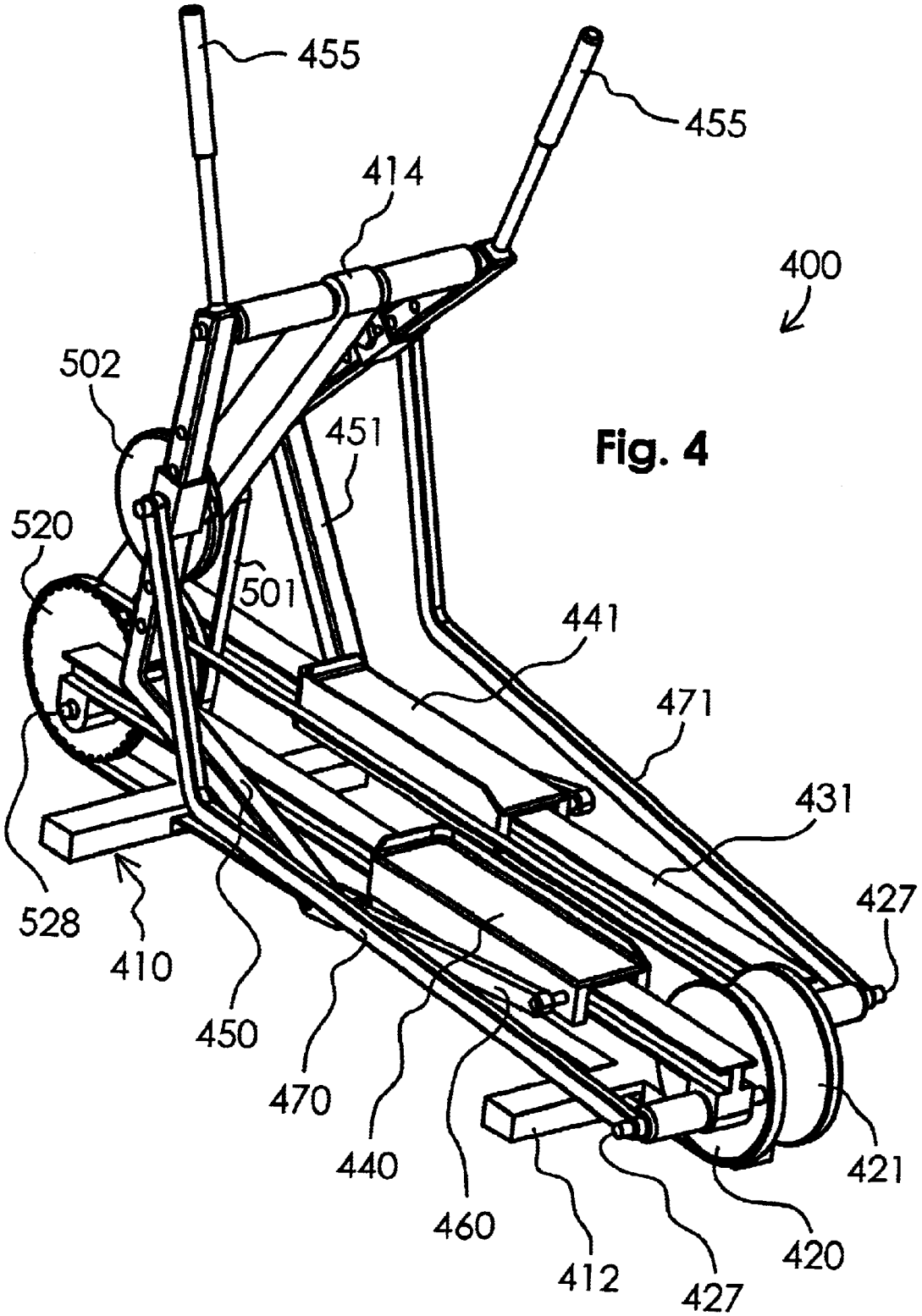
FIG. 4 is a perspective view of another exercise apparatus constructed according to the principles of the present invention.
Figure 5:
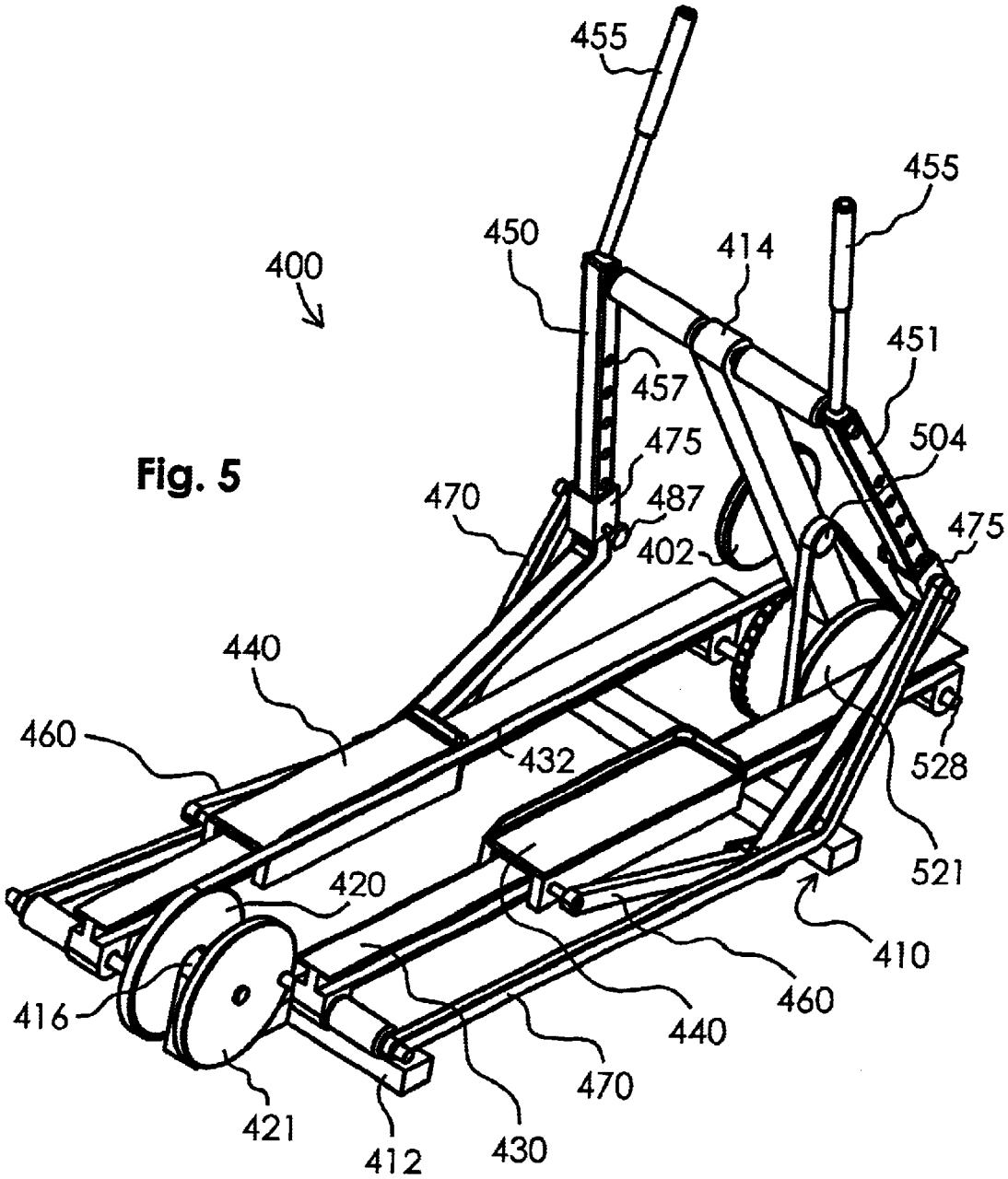
FIG. 5 is another perspective view of the exercise apparatus of FIG. 4.
Figure 6:
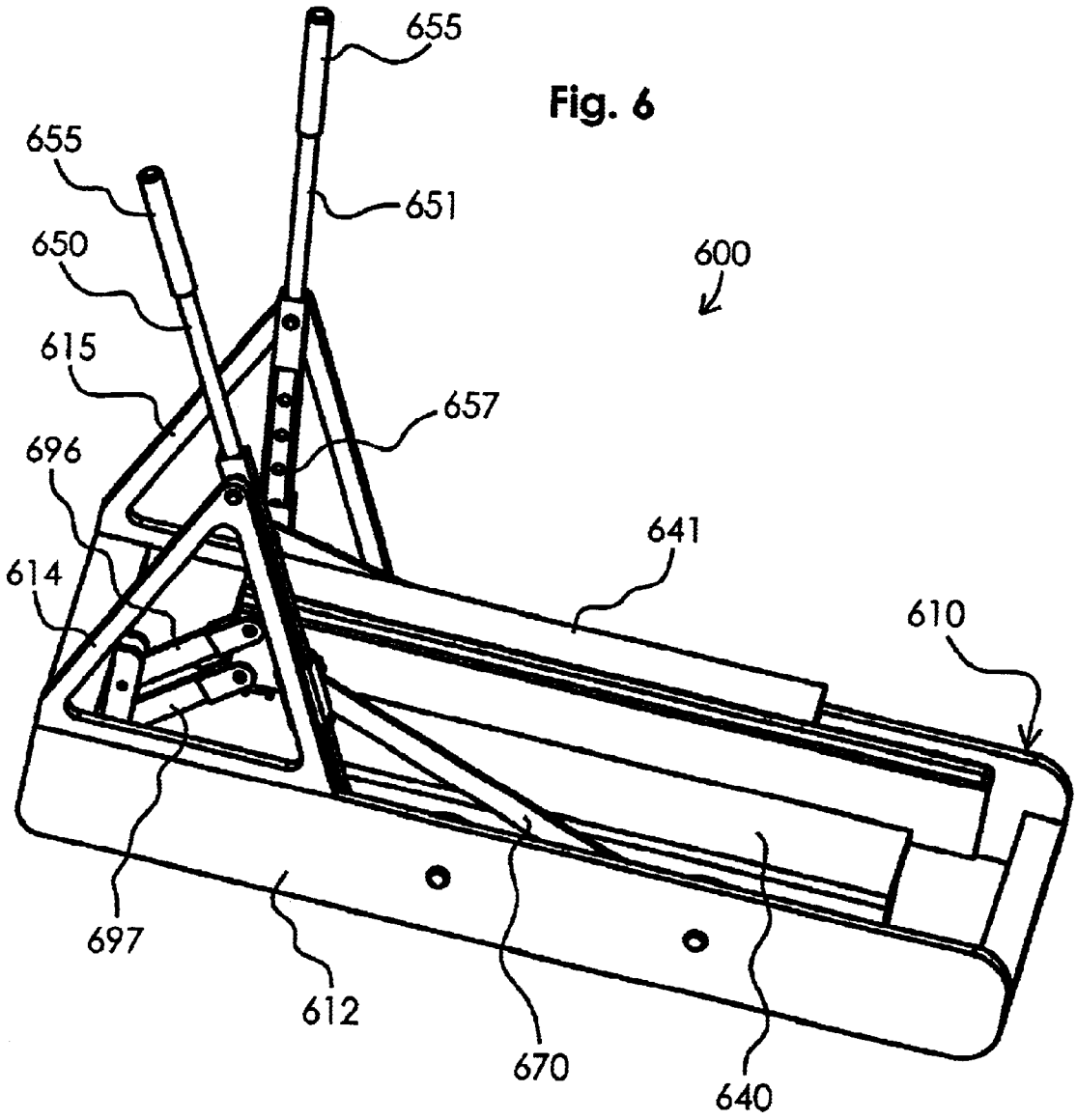
FIG. 6 is a perspective view of yet another exercise apparatus constructed according to the principles of the present invention.
Figure 7:
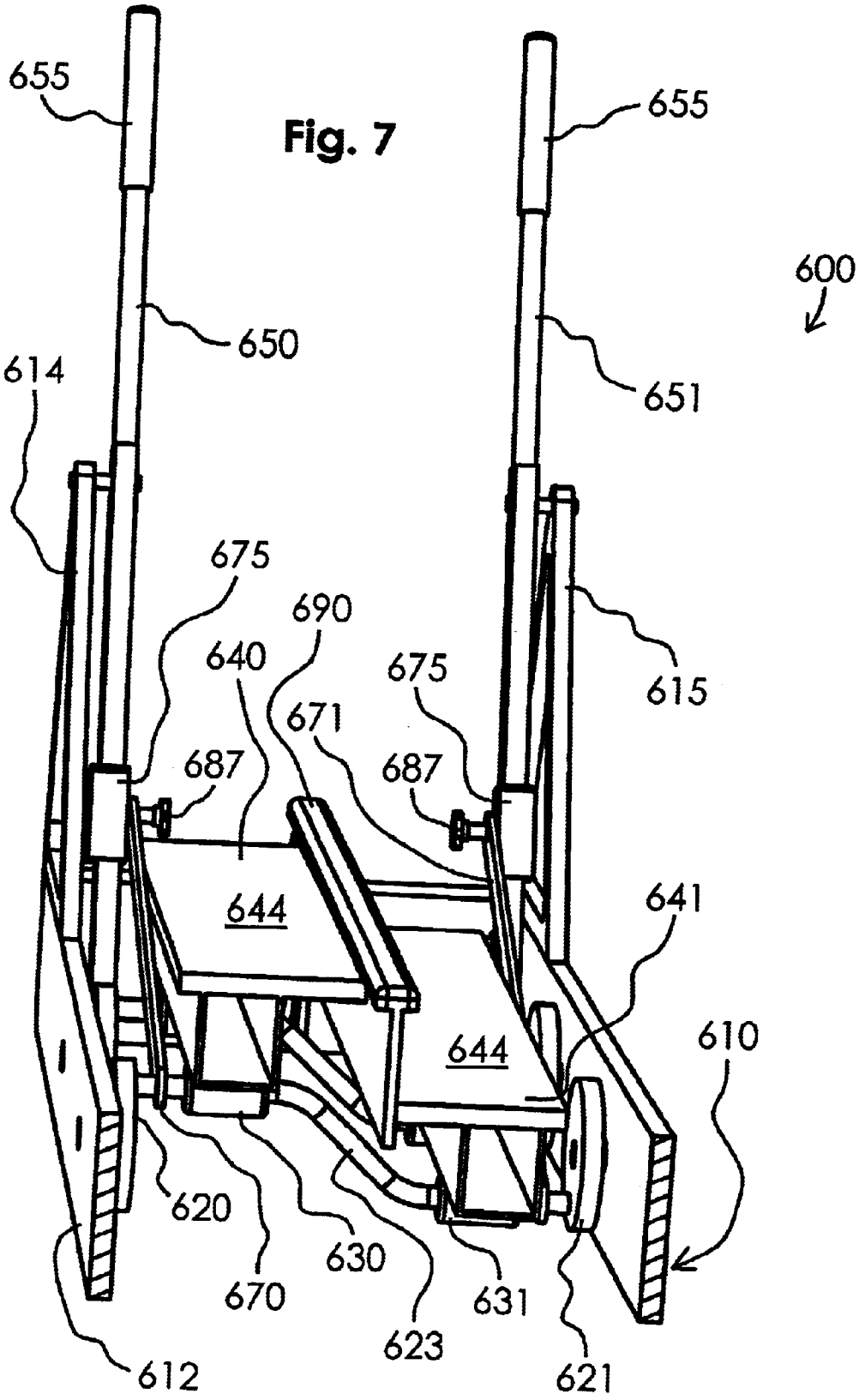
FIG. 7 is another perspective view of the exercise apparatus of FIG. 6.
Figure 8:
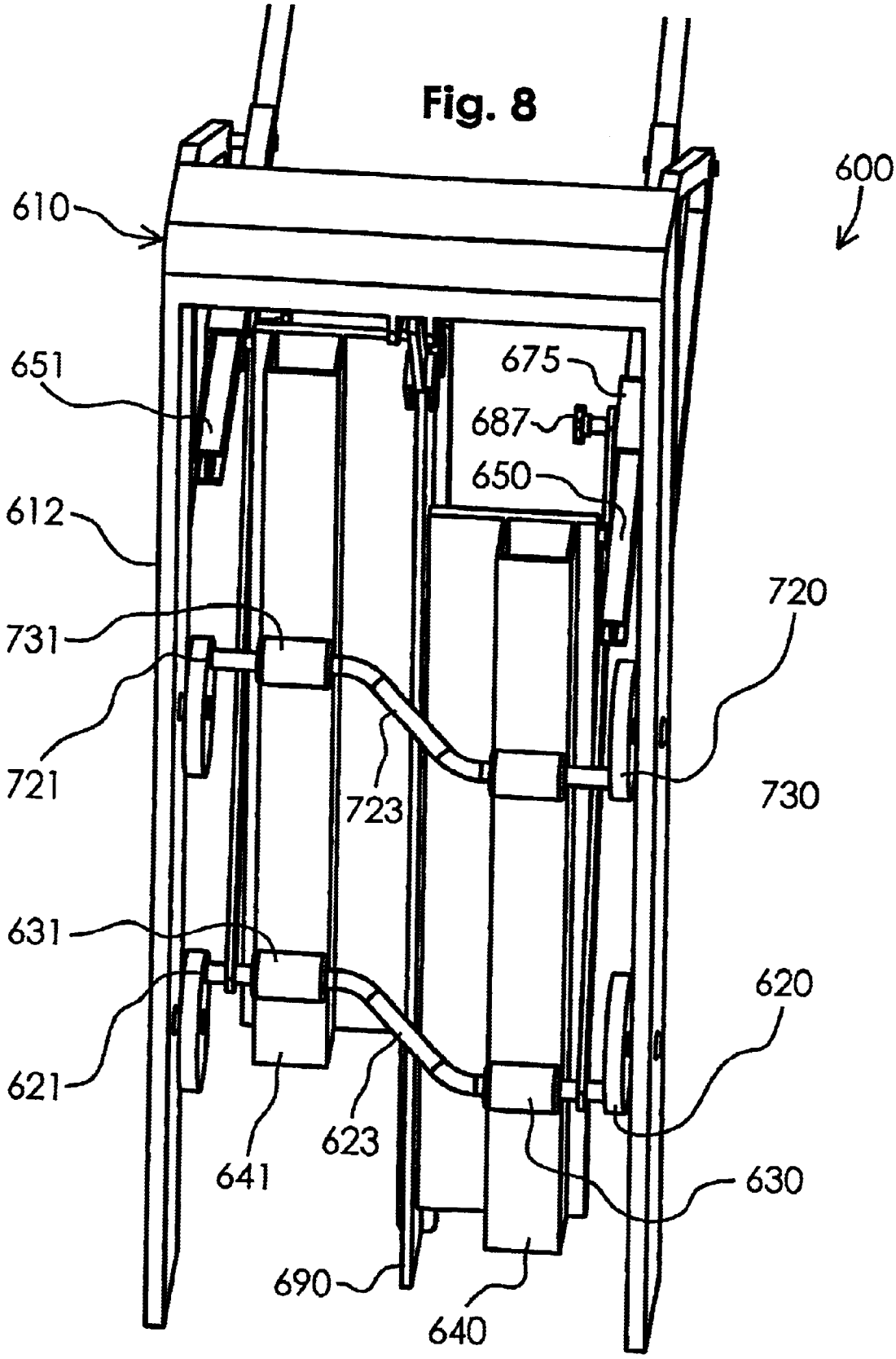
FIG. 8 is a partially fragmented, generally bottom view of the exercise apparatus of FIG. 6.

Another embodiment of the present invention is shown in FIGS. 4–5 and assigned reference numeral 400. The exercise machine 400 includes a frame 410 having a floor engaging base 412; a forward stanchion 414 that extends upward from the base 412; and a rearward stanchion 416 that extends upward from the base 412.

Rearward cranks 420 and 421 are rotatably mounted on the stanchion 416. The cranks 420 and 421 are keyed to a common shaft and rotate about a common crank axis. Left and right support shafts 427 are rigidly secured to radially displaced portions of respective cranks 420 and 421, thereby defining respective, diametrically opposed axes that rotate about the crank axis. Similarly, forward cranks 520 and 521 are rotatably mounted on the forward stanchion 414, keyed to a common shaft, and rotatable about a common crank axis. Left and right support shafts 528 are rigidly secured to radially displaced portions of respective cranks 520 and 521, and define respective, diametrically opposed axes that rotate about the forward crank axis.

A left rail 430 has a rearward end that is rotatably mounted on the left rearward support shaft 427, and an opposite, forward end that is rotatably mounted on the left forward support shaft 528. Similarly, a right rail 431 has a rearward end that is rotatably mounted on the right rearward support shaft 427, and an opposite, forward end that is rotatably mounted on the right forward support shaft 528. As a result, the rails 430 and 431 are constrained to move through circular paths in response to rotation of the cranks 420 and 421 and 520 and 521, while one hundred eighty degrees out of phase relative to one another.

A left foot support or skate 440 is movably mounted on the left rail 430, and a right foot support or skate 441 is movably mounted on the right rail 431. Rollers or bearings are preferably disposed between the foot supports 440 and 441 and respective rails 430 and 431 to facilitate a smooth gliding interface therebetween. In any event, the foot supports 440 and 441 are constrained to move vertically together with respective rails 430 and 431, but remain free to move horizontally relative to respective rails 430 and 431. In this regard, the "skate" arrangement effectively "decouples" the foot supports 440 and 441 from the horizontal displacement of the cranks 420 and 421 and 520 and 521.

Rocker links 450 and 451 are pivotally mounted on opposite sides of the forward stanchion 414 and pivotal about a common pivot axis. Each rocker link 450 and 451 has an upper distal portion 455 that is sized and configured for grasping. Each rocker link 450 and 451 has an opposite, generally L-shaped lower portion that extends downward and then rearward. Forward ends of respective intermediate links 460 are rotatably connected to lower distal ends of respective rocker links 450 and 451, and opposite, rearward ends of respective intermediate links 460 are rotatably connected to respective foot supports 440 and 441.

A left drawbar link 470 has a rearward end pivotally coupled to the left rearward crank 420, and a forward end pivotally coupled to an intermediate portion of the left rocker link 450. Similarly, a right drawbar link 471 has a rearward end pivotally coupled to the right rearward crank 421, and a forward end pivotally coupled to an intermediate portion of the right rocker link 451. In the alternative, the rearward end of each drawbar link 470 and 471 may be pivotally coupled to a respective rail 430 or 431 (outside the path of a respective foot support 440 or 441). In any event, each drawbar link 470 or 471 links rotation of a respective crank 420 or 421 to reciprocal pivoting of a respective rocker link 450 or 451. The "pivot arm" or radius associated with the drawbar links 470 and 471 is shorter than the "pivot arm" or radius associated with the intermediate links 460 and 461, so the foot supports 440 and 441 are constrained to move fore and aft to a greater extent than the drawbar links 470 and 471. The extent of this "amplification effect" may be adjusted by securing the drawbar links 470 and 471 in alternative locations along respective rocker links 450 and 451.

On the machine 400, the forward end of each drawbar link 470 or 471 is pivotally connected to a respective bracket 475, which in turn, is movably mounted on a respective rocker link 450 or 451. Low friction material is preferably disposed between the brackets 475 and respective rocker links 450 and 451 to facilitate a smooth gliding interface therebetween. Pins 487 are mounted on respective brackets 475, and are connected to respective rocker links 450 and 451 via respective holes 457. Spring latching arrangements or other known means may be provided to bias the pins 487 to remain in selected holes 457. As the brackets 475 are moved closer to the pivot axis of the rocker links 450 and 451, the amplification effect is increased, and the foot supports 440 and 441 are constrained to move through relatively longer paths.

The machine 400 is shown with a timing belt 432 looped about the left cranks 420 and 520. The timing belt 432 ensures reliable synchronization between the rearward cranks 420 and 421 and the forward cranks 520 and 521. The machine 400 is also shown with a flywheel 502 rotatably mounted on the left side of the forward stanchion 414, and a relatively small diameter pulley 504 rotatably mounted on the right side of the forward stanchion 414. The flywheel 502 and the pulley 504 are keyed to a common shaft, and a belt 501 is looped about both the pulley 504 and the relatively larger diameter crank 521. As a result, the flywheel 502 is constrained to rotate at a relatively faster speed than the crank 521. The flywheel 502 adds inertia to the linkage assemblies, and various types of known devices (such as a drag strap or an eddy current brake) may be operatively connected to the flywheel 502 to provide adjustable resistance, as well.

Yet another embodiment of the present invention is shown in FIGS. 6–9 and assigned reference numeral 600. The exercise machine 600 includes a frame 610 having a floor engaging base 612, and left and right supports 614 and 615 that extend upward from respective sides of the base 612 proximate its forward end.

Opposing pairs of cranks 620 and 621 and 720 and 721 are rotatably mounted on respective sides of the base 612. The rearward cranks 620 and 621 are rotatable about a common crank axis, and are rigidly interconnected by a support shaft 623. The shaft 623 has an intermediate portion that intersects the crank axis, and diametrically opposed end portions that are connected to respective cranks 620 and 621. Left and right rollers 630 and 631 are rotatably mounted on respective end portions of the shaft 623. The forward cranks 720 and 721 are also rotatable about a common crank axis, and are rigidly interconnected by a support shaft 723. The shaft 723 similarly has an intermediate portion that intersects the crank axis, and diametrically opposed end portions that are connected to respective cranks 720 and 721. Left and right rollers 730 and 731 are rotatably mounted on respective end portions of the shaft 723, as well.

A left beam 640 is disposed on top of the left rollers 630 and 730 and thereby rollably connected to the left end portions of respective shafts 623 and 723. As a result, the left beam 640 is constrained to move up and down together with the left cranks 620 and 720, while remaining free to move back and forth relative thereto. Similarly, a right beam 641 is disposed on top of the right rollers 631 and 731 and thereby rollably connected to the right end portions of respective shafts 623 and 723. As a result, the right beam 641 is constrained to move up and down together with the right cranks 621 and 721, while remaining free to move back and forth relative thereto. A respective foot support or platform 644 is provided on top of each beam 640 and 641. As a result of the "roller" arrangement, each foot support 644 is effectively "de-coupled" from the horizontal displacement of the cranks 620 and 621 and 720 and 721.

A shield or divider 690 is disposed between the foot platforms 644, and parallel links 696 and 697 are pivotally interconnected between the forward end of the divider 690 and the forward end of the base 612. The divider 690 has a generally T-shaped profile, and opposite ends of the relatively wider, upper portion 694 overlie respective foot platforms 644. As a result, the divider 690 is always supported by the relatively higher of the two foot platforms 644, and the relatively thinner, lower portion of the divider 690 shields the foot and ankle on the relatively lower of the two foot platforms 644.

Figure 9:
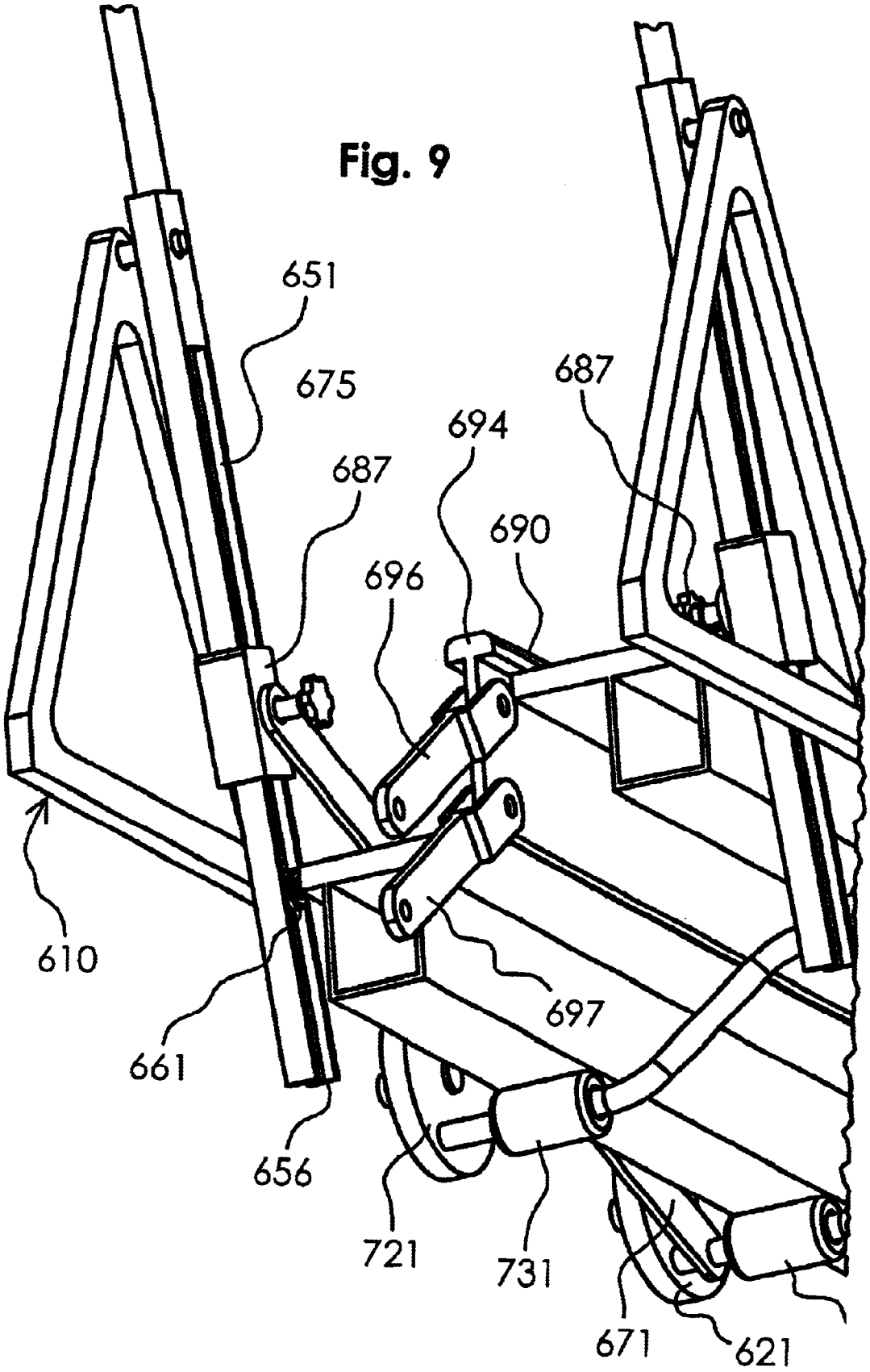
FIG. 9 is an enlarged, partially fragmented, perspective view of a the exercise apparatus of FIG. 6.

Rocker links 650 and 651 are pivotally mounted on respective supports 614 and 615 and pivot about a common pivot axis. Each rocker link 650 and 651 has an upper distal portion 655 that is sized and configured for grasping. Each rocker link 650 and 651 has an opposite, lower distal portion that defines a channel or track 656. As shown in FIG. 9, a roller 661 is rotatably mounted on the forward end of the right beam 641 and disposed inside the channel 656. A similar roller arrangement links the left beam 640 and the left rocker link 650.

A left drawbar link 670 has a rear end pivotally coupled to the left rearward crank 620, and a forward end pivotally coupled to an intermediate portion of the left rocker link 650. Similarly, a right drawbar link 671 has a rear end pivotally coupled to the right rearward crank 621, and a forward end pivotally coupled to an intermediate portion of the right rocker link 651. Each drawbar link 670 or 671 links rotation of a respective crank 620 or 621 to reciprocal pivoting of a respective rocker link 650 or 651. The "pivot arm" or radius associated with the drawbar links 670 and 671 is shorter than the "pivot arm" or radius associated with the rollers 661, and thus, the beams 640 and 641 are constrained to move fore and aft to a greater extent than the drawbar links 670 and 671. The extent of this "amplification effect" may be adjusted by securing the drawbar links 670 and 671 in alternative locations along respective rocker links 650 and 651.

On the machine 600, the forward end of each drawbar link 670 or 671 is pivotally connected to a respective bracket 675, which in turn, is movably mounted on a respective rocker link 650 or 651. Low friction material is preferably disposed between the brackets 675 and respective rocker links 650 and 651 to facilitate a smooth interface therebetween. Pins 687 are mounted on respective brackets 675 and inserted into holes 657 (see FIG. 6) in respective rocker links 650 and 651. Spring detents or other known means may be provided to bias the pins 687 to remain in selected holes 657. As the brackets 675 are moved closer to the pivot axis of the rocker links 650 and 651, the amplification effect is increased, and the foot platforms 644 are constrained to move through relatively longer paths.

The machine 600 may be provided with a timing belt and/or a synchronization bar interconnected between one of the rearward cranks 620 and 621 and a respective forward crank 720 or 721. The machine 600 may also be provided with various devices suitable for adding inertia to the linkage arrangement and/or resisting motion associated therewith.

The foregoing description makes reference to particular embodiments and specific applications, with the understanding that additional embodiments, improvements, and/or applications also fall within the scope of the present invention. Among other things, elements and/or features on various embodiments may be mixed and matched in various ways. For example, one such additional embodiment has left and right rails pivotally coupled to respective left and right first cranks, and left and right foot supports rollably mounted on respective left and right second cranks. The foot platforms are connected in telescoping fashion to respective rails, and the foot platforms are driven fore and aft via a drawbar and rocker link arrangement like those described above. With the foregoing in mind, the scope of the present invention should be limited only to the extent of the following claims.

What is claimed is:

1. An exercise apparatus, comprising:

a frame having a base that is configured to rest upon a floor surface;

a left first crank and a right first crank, wherein each said first crank is rotatably mounted on the frame;

a left second crank and a right second crank, wherein each said second crank is rotatably mounted on the frame;

a left foot support and a right foot support;

a left connecting means for rollably connecting the left foot support to each said left crank;

a right connecting means for rollably connecting the right foot support to each said right crank;

a left rocker link and a right rocker link, wherein each said rocker link is pivotally mounted on the frame and operatively connected to a respective foot support;

a left drawbar link having a first portion connected to the left rocker link, and a second portion constrained to rotate together with each said left crank, wherein the left drawbar link and the left rocker link cooperate to link rotation of each said left crank to horizontal movement of the left foot support relative to the left connecting means; and a right drawbar link having a first portion connected to the right rocker link, and a second portion constrained to rotate together with each said right crank, wherein the right drawbar link and the right rocker link cooperate to link rotation of each said right crank to horizontal movement of the right foot support relative to the right connecting means.

2. The exercise apparatus of claim 1, wherein an upper distal end of each said rocker link is sized and configured for grasping.

3. The exercise apparatus of claim 1, wherein the left connecting means includes a roller rotatably mounted on the left first crank and a roller rotatably mounted on the left second crank, and the right connecting means includes a roller rotatably mounted on the right first crank and a roller rotatably mounted on the right second crank.

4. The exercise apparatus of claim 3, wherein the left foot support is a left beam that is supported on the roller on the left first crank and the roller on the second left crank, and the right foot support is a right beam that is supported on the roller on the right first crank and the roller on the second right crank.

5. The exercise apparatus of claim 4, wherein a left roller is rotatably mounted on the left beam and disposed within a track on the left rocker link, and a right roller is rotatably mounted on the right beam and disposed within a track on the right rocker link.

6. The exercise apparatus of claim 1, wherein the left drawbar link cooperates with the left rocker link to define a left rotational axis that is selectively movable along the left rocker link, and the right drawbar link cooperates with the right rocker link to define a right rotational axis that is selectively movable along the right rocker link.

7. The exercise apparatus of claim 6, wherein the left rotational axis is defined by a left pin that extends through a hole in the left drawbar link and an aligned hole in the left rocker link, and the right rotational axis is defined by a right pin that extends through a hole in the right drawbar link and an aligned hole in the right rocker link.

8. The exercise apparatus of claim 1, wherein each said first crank is disposed between left and right first bearing assemblies, and each said second crank is disposed between left and right second bearing assemblies.

9. The exercise apparatus of claim 1, further comprising left and right adjusting means, interconnected between respective rocker links and respective drawbar links, for adjusting associated points of interconnection along respective rocker links.

10. The exercise apparatus of claim 9, wherein each said adjusting means includes a bracket that is slidably mounted on a respective rocker link and rotatably connected to a respective drawbar link.

11. The exercise apparatus of claim 10, wherein each said adjusting means includes a pin mounted on a respective bracket and sized and configured to fit into any one of a plurality of holes in a respective rocker link.

12. The exercise apparatus of claim 1, wherein a left roller is rotatably mounted on the left foot support and disposed within a track on the left rocker link, and a right roller is rotatably mounted on the right foot support and disposed within a track on the right rocker link.

13. An exercise apparatus, comprising:

a frame having a base that is configured to rest upon a floor surface;

a first left crank and a first right crank, wherein each said first crank is rotatably mounted on the frame;

a second left crank and a second right crank, wherein each said second crank is rotatably mounted on the frame;

a left foot supporting assembly supported by the first left crank and the second left crank;

a right foot supporting assembly supported by the first right crank and the second right crank;

a left rocker link and a right rocker link, wherein each said rocker link is pivotally mounted on the frame and operatively connected to a respective foot supporting assembly;

a left drawbar link having a first portion connected to the left rocker link, and a second portion constrained to rotate together with each said left crank, wherein the left drawbar link and the left rocker link cooperate to link horizontal displacement of each said left crank to relatively greater horizontal displacement of the left foot supporting assembly; and a right drawbar link having a first portion connected to the right rocker link, and a second portion constrained to rotate together with each said right crank, wherein the right drawbar link and the right rocker link cooperate to link horizontal displacement of each said right crank to relatively greater horizontal displacement of the right foot supporting assembly.

14. The exercise apparatus of claim 13, wherein the left foot supporting assembly includes a first left roller rotatably mounted on the first left crank, a second left roller rotatably mounted on the second left crank, and a left beam supported on each said left roller, and the right foot supporting assembly includes a first right roller rotatably mounted on the first right crank, a second right roller rotatably mounted on the second right crank, and a right beam supported on each said right roller.

15. The exercise apparatus of claim 13, further comprising left and right adjusting means, interconnected between respective rocker links and respective drawbar links, for adjusting associated points of interconnection along respective rocker links.

16. The exercise apparatus of claim 15, wherein each said adjusting means includes a bracket that is slidably mounted on a respective rocker link and rotatably connected to a respective drawbar link.

17. The exercise apparatus of claim 16, wherein each said adjusting means includes a pin mounted on a respective bracket and sized and configured to fit into any one of a plurality of holes in a respective rocker link.

18. The exercise apparatus of claim 13, wherein a left roller is rotatably mounted on the left foot supporting assembly and disposed within a track on the left rocker link, and a right roller is rotatably mounted on the right foot supporting assembly and disposed within a track on the right rocker link.

19. The exercise apparatus of claim 1, wherein each said rocker link has an upper end that is sized and configured for grasping.

20. The exercise apparatus of claim 13, further comprising a means for synchronizing rotation of each said crank.

21. An elliptical motion exercise apparatus, comprising:

a frame having a base that is configured to rest upon a floor surface;

left and right forward cranks rotatably mounted on the frame;

left and right rearward cranks rotatably mounted on the frame;

a left foot support supported on the left cranks;

a right foot support supported on the right cranks;

a left rocker link pivotally mounted on the frame, and linked to the left foot support;

a left drawbar link having a first portion that is linked to the left rocker link, and a second portion that is constrained to rotate together with the left cranks;

a right rocker link pivotally mounted on the frame, and linked to the right foot support; and a right drawbar link having a first portion that is linked to the right rocker link, a second portion that is constrained to rotate together with the right cranks.

22. The exercise apparatus of claim wherein a respective roller is rotatably mounted on each of said cranks immediately beneath a respective foot support.

23. An elliptical motion exercise apparatus, comprising:

a frame having a base that is configured to rest upon a floor surface;

left and right forward cranks rotatably mounted on the frame at a common, forward crank axis;

left and right rearward cranks rotatably mounted on the frame at a common, rearward crank axis;

a left foot support interconnected between the left cranks and constrained to remain oriented at a particular angle during rotation of the left cranks;

a right toot support interconnected between the right cranks and constrained to remain oriented at a particular angle during rotation of the right cranks;

a left constraining means for constraining the left foot support to move fore and aft relative to the left cranks during rotation of the left cranks; and a right constraining means for constraining the right foot support to move fore and aft relative to the right cranks during rotation of the right cranks.

24. The exercise apparatus of claim 23, wherein each said constraining means includes a respective rocker link pivotally mounted on the frame and operable to amplify fore and aft movement of a respective foot support relative to fore and aft movement of respective cranks.

* * * * *